US007141770B2

(12) United States Patent
Zafiroglu et al.

(10) Patent No.: US 7,141,770 B2
(45) Date of Patent: Nov. 28, 2006

(54) MICROWAVE COOKING PACKAGE WITH NON-STICK ABSORBING PAD

(75) Inventors: Dimitri P Zafiroglu, Centreville, DE (US); Richard I Lacy, Wilmington, DE (US)

(73) Assignee: Xymid, L.L.C., Midlothian, VA (US)

( * ) Notice: Subject to any disclaimer, the term of this patent is extended or adjusted under 35 U.S.C. 154(b) by 0 days.

(21) Appl. No.: 11/141,722

(22) Filed: May 31, 2005

(65) Prior Publication Data

US 2005/0269318 A1 Dec. 8, 2005

Related U.S. Application Data

(60) Provisional application No. 60/576,928, filed on Jun. 4, 2004.

(51) Int. Cl.
*H05B 6/80* (2006.01)
*A21D 10/02* (2006.01)

(52) U.S. Cl. ..... 219/725; 426/109

(58) Field of Classification Search ..... 219/725, 219/726, 727, 728, 729, 738, 733; 426/109, 426/107, 108

See application file for complete search history.

(56) References Cited

U.S. PATENT DOCUMENTS

| | | | | |
|---|---|---|---|---|
| 4,720,410 | A | 1/1988 | Lundquist et al. | 428/136 |
| 4,786,513 | A | 11/1988 | Monforton et al. | 426/107 |
| 4,865,854 | A | 9/1989 | Larson | 426/107 |
| 4,873,101 | A | 10/1989 | Larson et al. | 426/113 |
| 5,096,722 | A | 3/1992 | Bair | 426/107 |
| 6,274,229 | B1 * | 8/2001 | Weidner et al. | 428/213 |
| 6,444,963 | B1 * | 9/2002 | Donahue | 219/678 |
| 6,608,292 | B1 * | 8/2003 | Barnes | 219/730 |
| 6,730,895 | B1 * | 5/2004 | Kim | 219/682 |
| 2004/0040954 | A1 * | 3/2004 | Kim | 219/681 |
| 2004/0164074 | A1 * | 8/2004 | Newton | 219/734 |

* cited by examiner

*Primary Examiner*—Daniel Robinson
(74) *Attorney, Agent, or Firm*—Jeffrey C. Lew

(57) ABSTRACT

A microwavable package has a pad for absorbing fat, grease, oil, moisture, and like liquid exuded from food, primarily meat, during cooking. The pad has a high-melting, liquid-transmissible, stiff, shrink-resistant, preferably foraminous face layer in contact with the food. A body layer is in contact with the face layer opposite the food. During cooking, the food releases liquid that transfers through the face layer where it contacts and is absorbed by the body layer. The face layer resists adhering to the food and therefore can be easily separated from the food after cooking.

10 Claims, 3 Drawing Sheets

MICROWAVE COOKING PACKAGE WITH NON-STICK ABSORBING PAD

This application claims priority of U.S. provisional patent application No. 60/576,928 filed Jun. 4, 2004.

FIELD OF THE INVENTION

This invention relates to microwave-ready packages for foods. More specifically it relates to pre-packed microwave packages of meat having an absorbent pad to catch fat from cooking.

BACKGROUND OF THE INVENTION

Microwave cooking packages, consisting of microwave-transparent enclosures wherein the food rests on a microwave-transparent absorbent pad within the sealed enclosure are disclosed, for example in U.S. Pat. No. 4,865,854 and U.S. Pat. No. 4,873,101. In addition U.S. Pat. No. 5,096,722 describes an improved absorbent pad to be used within the packages described in the '854 and '101 patents. The improved pad has higher temperature resistance and sufficient microwave transparency to handle more severe cooking conditions. Other references describe multilayer cooking for example, U.S. Pat. No. 4,786,513, and special "blotters" or absorbent pads U.S. Pat. No. 4,720,410.

U.S. Pat. No. 5,096,722, mentioned above acknowledges the need for an absorbent pad totally free of finishing chemicals, microwave transparent and having a relatively high melting point (above 450° F.). It also describes a smooth pad face, totally free of finishes, consisting of a spunbonded polyester nonwoven attached to a needle-punched polyester staple grease-adsorbent batt. Other references mention lower melting materials for microwave cooking package pads such as polypropylene, poly-4-methyl-pentene-1. Such pads of lower melting materials can soften and conform to the surface of cooking and shrinking meats. The entire disclosures of each patent mentioned herein is hereby incorporated by reference.

It has now been discovered that during cooking excessive adhesion of food to the microwave cooking package materials of prior art systems can occur. Food adhesion can be problematic even with a system of the '722 patent despite its use of higher temperature-resistant and relatively chemical- and finish-free materials. Excessive food adhesion is particularly noteworthy when lean and heavy meats are microwave-cooked, and especially when the absorbent pad shrinks along with the cooked meats and/or conforms to the shrinking meat surface.

SUMMARY OF THE INVENTION

The present invention provides an oil absorbent pad for use in microwave cooking food, a microwavable food package, a system for packaging microwavable food products and a method of cooking a food item using a microwavable food package. The invention utilizes a microwave transparent pouch and an absorbent pad in the pouch. The pad has a liquid absorbent body layer and a shrink-resistant face layer deployed in contact with an item of food. Preferably, the face layer melts at temperatures above about 450° F. and deforms less than about 20% of its original, ambient condition dimensions when exposed to temperatures in the range of about 450° F. up to its melting temperature. Liquid released by the food during cooking, such as fat, grease and oil, is absorbed by the body layer and the tendency of the food to adhere to the face layer of the pad is remarkably low.

Accordingly, there is now provided an absorbent pad for microwave cooking comprising a liquid transmissible face layer and a body layer of liquid-retaining, absorbent material in direct contact adjacent to the face layer, the face layer and body layer being microwave transparent, in which the face layer upon exposure to a temperature of at least 450° F. deforms laterally less than 20% of dimensions measured prior to such exposure.

There is also provided a system for cooking food comprising (a) a microwave transparent, cooking temperature-resistant container, and (b) a microwave transparent absorbent pad in the container comprising (1) a body layer comprising an oily liquid-absorbent material, and (2) a liquid transmissible, shrink-resistant face layer, in which the face layer is dimensionally stable upon exposure to a temperature of at least 450° F.

Yet further this invention provides a method of making an absorbent pad comprising the steps of (a) providing a microwave transparent body layer of oily liquid-absorbent material, (b) providing a microwave transparent face layer of liquid transmissible material which face layer after being exposed to a temperature of at least 450° F. deforms laterally less than 20% of dimensions measured prior to such exposure, and (c) placing a side of the face layer adjacent and in direct contact with a side of the body layer.

Additionally, there is now provided a method of cooking a food item comprising the steps of (a) providing a microwave transparent absorbent pad comprising a liquid transmissible face layer and a liquid absorbent body layer in direct contact adjacent to the face layer and which face layer after being exposed to a temperature of at least 450° F. shrinks laterally less than 20% of dimensions measured prior to such exposure, (b) providing an item of food to be cooked, (c) supporting the item of food on the absorbent pad in contact with the face layer, (d) radiating the food item with microwave radiation effective to raise the temperature of the food item above about 450° F. for a duration effective to cook the food item and to exude liquid from the item of food onto the face layer of the absorbent pad, (e) transferring at least a portion of the liquid exuded from the food item through the face layer into the body layer, (f) absorbing most of the liquid transferred through the face layer into the body layer, and (g) removing the food item from contact with the absorbent pad.

DETAILED DESCRIPTION OF THE INVENTION

Figure 1:
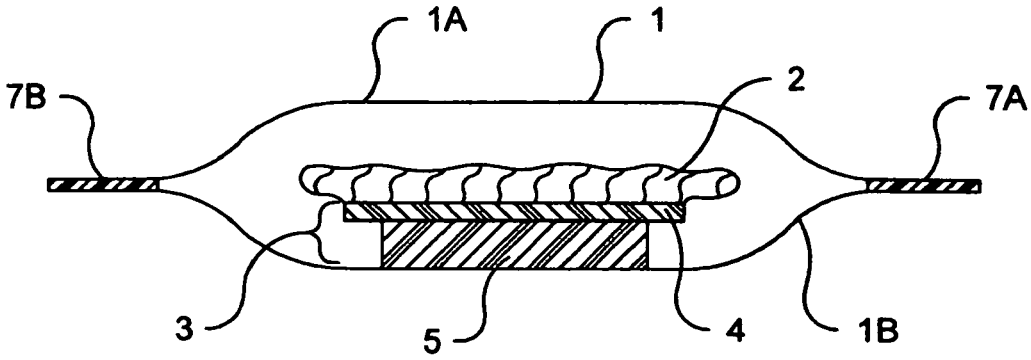
FIG. 1 is a section view of a microwave cooking packaging system showing an absorbent pad according to one embodiment of this invention.

In one aspect, this invention concerns a microwavable package facilitating the cooking of food that exudes oil, grease, fat and the like during the cooking process. It further relates to a microwave-transparent pouch having within it an absorbent element, preferably in contact with the cooking food, and in which the absorbent element contacting the food exhibits very little lateral deformation during the cooking and optionally the subsequent food serving processes. Preferably, the absorbent element is a composite structure, occasionally referred to herein as a pad. The pad has a face layer which contacts the food during cooking and a body layer that absorbs liquids of cooking. The face layer is such that fluid exuded from the food can pass through it and into the body layer where the fluid is absorbed such that less liquid is served to the consumer with the food.

It has been discovered that dimensional stability (i.e., resistance to lateral deformation) of the food-contacting portion of the absorbent element during the cooking process enhances non-adherence to the food which the element contacts. Occasionally the term "shrink resistance" is used herein interchangeably with the term "dimensional stability" and are both intended to embrace resistance to extension (i.e., expansion) as well as contraction.

Dimensional stability largely eliminates adhesion of the absorbent element to the food. Consequently, after cooking it is advantageously simple and expeditious to remove the cooked food items from the pouch for serving because little effort, if any, is expended to peel away absorbent element material from the food. Also, there is little food product waste from food sticking to absorbent material that must be discarded. This invention is notably effective with relatively lean meats or large, heavy portions of meats. These types of food tend to adhere agressively to adjacent cooking surfaces that deform with the meat during cooking including conventional absorbent materials for microwave cooking packages. The novel absorbent pad also is adhesion-resistant to many other types of foods and therefore this invention should not be construed to be limited to use with only lean or large, heavy meats.

Although this invention may find use in permanent or re-usable cooking systems, it is primarily intended for disposable systems. That is, the product is mainly targeted to single-use applications in which prepared, cooked or uncooked food is placed in the pouch, the pouch is positioned in a microwave oven, the oven is operated to cook the food inside the pouch, the pouch is removed from the microwave oven and is opened, usually by tearing, cutting or otherwise destroying the pouch material to retrieve the food. Lastly, the emptied pouch is discarded after one use.

The primary application for this invention is pre-packaged, typically frozen or refrigerated foods that are distributed to the consumer within a sealed pouch impervious to liquid and gas transfer in which the food is positioned in contact with the absorbent pad. These foods can be uncooked, partially cooked or fully cooked when sealed within the package by the distributor. The consumer places the entire sealed pouch with food into an oven in which the food is cooked while inside the pouch. Optionally and as sometimes called for by the distributor's cooking instructions, the consumer will pierce the outer wall of the manufacturer-sealed pouch to permit escape of gases emitted during cooking. In another contemplated application, the consumer can purchase a package system with a sealable pouch and an absorbent pad. The food is purchased separately and independently of this package system. In that case the consumer can insert a food item into the pouch for cooking.

In yet another contemplated application, the absorbent pad according to this invention can be obtained separately from a cooking package. Then the consumer can place a food item on the absorbent pad in the consumer's cooking container, e.g. pot, pan, plate for cooking. As mentioned, the main expected utility for this invention is for foods cooked by radiation in microwave ovens. When so used, the cooking container should be microwave transparent. As used herein the term "microwave transparent" means that a material does not significantly interfere with or otherwise affect microwave radiation transmitted through it for cooking food and that the material is itself not adversely affected by microwave radiation in amounts normally used in cooking food. When the absorbent pad of this invention is used in connection with a pouch, conventional microwave-transparent pouch materials which are well known in the art, such as optically transparent polymer films can be used.

Food items and especially meats tend to change shape when cooked at high temperatures. Usually foods shrink. The inventors have found that generally the cooked food tends to adhere to its support, such as an absorbent pad in microwave cooking, particularly when the support surface in contact with the food contracts and/or conforms to the changing surface of the food during cooking. Conversely, it has been discovered that food will consistently not adhere to the pad during cooking provided that the food-contacting surface maintains dimensional stability during cooking.

The invention can be understood with reference to the figures. In the drawings, like parts have the same reference numbers. FIG. 1 illustrates a section view of an embodiment in which a food item 2 is pre-packaged within a microwave-transparent pouch 1 of polymer film. The pouch is fabricated from two polymer film layers 1A,1B that are sealed at peripheral edges 7A,7B such that the pouch is fluid-impervious. The food item is supported within the pouch on an absorbent pad 3 constructed according to the present invention. The pad has a face layer 4 in contact with the food item and a body layer 5 integral with the face layer but separated from the food by the face layer. The face layer is dimensionally stable under cooking conditions. It is also adapted to transfer liquids exuded from the food item during cooking through the face layer to the body layer. The body layer is operative to absorb the exuded liquids that reach it either by transmission through the face layer or by overflow from the edges of the face layer.

The extent to which foods tend to stick to a supporting absorbent pad during cooking is affected by numerous factors. It has been mentioned above that food having high fat or high moisture content tends not to adhere as frequently or as much as low fat or low moisture content food. Also heavy pieces of meat are in general more adhesive than lighter pieces. Broadly and simplistically characterized, the degree of adhesion seems to vary with the amount of fat and/or moisture content of the food that can exude during cooking. Without wishing to be bound by a particular theory, we observe that the fluid exuded from the food being cooked tends to weaken adhesion between the food and the supporting contact surface. Still, there is much variability and unpredictability with respect to the extent to which foods will stick to absorbent pads.

It has now been found that using absorbent pads in which at least the food-contacting face is dimensionally stable during cooking provides more universal and consistent adhesion resistance. That is, it advantageously provides consistently low- and normally non-adhesion of low fat/moisture containing foods as well as high fat/moisture containing foods. Therefore, as compared to absorbent materials of traditional microwave cooking technology, adhesion of food to the absorbent pad according to this invention is greatly reduced for low fat/moisture foods and is routinely eliminated for medium and high fat/moisture foods. We believe that the oily liquid somewhat interferes with the bonding between the food and the absorbent surface and that adhesion can be further greatly reduced by enabling the food surface to move relative to the absorbent surface. The relative motion diminishes the time in which a part of the food stays in direct contact with a corresponding part of the absorbent surface where a bond can form. It also increases tension between the food and absorbent surfaces at points of contact which promotes the shearing apart of bonds that begin to form. Relative motion is induced by maintaining dimensional stability of the absorbent pad surface while allowing the food to shrink naturally by being cooked.

Dimensional stability effective to provide consistent adhesion resistance of food to an absorbent pad is usually achieved when the face layer deforms less than 20% when exposed to food cooking temperatures relative to lateral dimensions measured at ambient conditions. In contrast, cooking with pads that shrink more than 20% provide variable amounts of food adhesion. It is further observed that the degree of adhesion reduction relates to the amount of shrinking. More specifically, more adhesion occurs with face layers that shrink more. Preferably, the face layer should exhibit cooking deformation of less than 10%, and more preferably, less than 5%.

Deformation of an absorbent pad during cooking can occur for various reasons, such as heat-shrinking. Cooking foods and meat in particular calls for exposing the supporting materials to high temperatures. Many high temperature-resistant and microwave transparent materials include polymeric films formed by extrusion, blow molding or other melt-processing techniques. When the polymer melt is cooled to create the packing product, frequently internal stresses are established within the resulting initially solidified material. Upon heating during cooking, the molecular structure of the packaging material can be mobilized such that the material contracts to relieve the stresses. Therefore, heat-shrink characteristics is a concern in selecting candidate materials for an absorbent pad face layer and body layer according to this invention. Some materials, for example, polymer films formed by solvent evaporation processing, are innately heat-shrink-resistant because on heating they do not contract or expand laterally more than 20% from initial dimensions. These are prospectively suitable candidates. Materials which are innately heat-shrinkable may also be useful provided that they can be made non-heat-shrinkable. Some methods for doing this, such as thermal annealing and tensioning, are discussed in context with certain embodiments of this invention, below.

Another possible reason that a material might undesirably deform excessively for use in this invention is a low melting point. Generally, at the melting point a substance achieves phase transition from a solid to a liquid. In the liquid state, the substance has no dimensional stability. As mentioned, many candidate materials for microwave food cooking packages are polymeric and they soften as they approach the melting temperature. Softening reduces structural integrity and the shape-retaining capability of the material. For suitability in this invention, the candidate substance should have a high enough melting point that it does not liquefy or soften during cooking, that is the melting temperature should be above the maximum food cooking temperature. For many microwave cooking food package utilities, it is desirable that the melting point temperature of the face layer composition, and as appropriate, the body layer composition should be above 450° F. Representative generally acceptable compositions include polyamides, polyimides, polyesters, silicone polymers and cellulose polymers.

Another factor that can contribute to undesirable lateral deformation of the face layer of the pad is lack of structural integrity. The pad should be effectively structurally strong that the face layer does not laterally deform by more than 20% during cooking. To the extent that the body layer can impact upon ability of the face layer to resist changing shape, the body layer should also be structurally sound and, at most, deformable by 20%. For example, although suitably heat shrink-resistant and high-melting/softening, a face layer of very thin and/or flimsy film might be so structurally weak as to still deform too much during cooking because of inability to resist shearing stresses transmitted from the shrinking food and/or body layer. That is, the film would not itself shrink but rather buckle, gather, crumple and otherwise conform to the irregular surface of the shrinking food. Parts of the film surface could stay in direct contact with corresponding parts of the food surface despite shrinking of the food and excessive adhesion could occur.

It follows that the absorbent pad should be suitably robust and rigid to avoid excessive deformation as the absorbent pad reaches cooking temperatures. That is, the face layer, and optionally, the body layer should have bending stiffness and shape retention effective to provide rigidity that withstands crumpling, gathering, buckling and the like, that could be caused by shearing the pad against the food and container at temperatures near or above 450° F. Typical structural factors that can affect the rigidity of the absorbent pad include thickness of the face layer, thickness of the body layer, amount of bonding between face and body layers, density of the face layer and/or body layer, and reinforcement of the pad such as by adding stiffening members and/or by shaping the pad for example by embossing to resist lateral compression. Certain structural techniques for improving rigidity and resistance to deformation are discussed below in context of selected embodiments. Increasing density or thickness of the face layer can interfere with the transfer of liquid grease, oil, fat and moisture from the food to the absorbent body layer. The barrier to liquid transfer can be reduced by perforating the face layer to provide openings for the liquid to flow into the body layer.

Having the benefit of this disclosure, the practitioner of ordinary skill will appreciate that dimensional stability suitable to achieve desired results can be obtained using a combination of performance factors including high melting temperature, shrink-resistant materials formed into stiff structures. A preferred absorbent pads comprises a face layer of a cellulosic or aramid/cellulose blend in dense, perforated paper form. Other preferred pads comprise polyester or polyamide composition formed into a relatively thin perforated sheet optionally embossed to improve stiffness.

A preferred method of rendering the face layer and optionally the body layer of the absorbent pad dimensionally stable uses thermal treatment. Unlike conventional cooking processes such as radiation from a hot fire or a radiant hot surface, and convection in a hot furnace, or conduction from a hot grill, in microwave cooking heat generates from within the food. Usually the food at any given moment is at a higher temperature than the support and heat transmits from the food to the adjoining absorbent pad surface. Most microwave-transparent materials for cooking are polymeric and on heating exhibit a braod phase transition temperature range at which they soften and become more pliable in a range of temperatures until reaching a temperature at which they cannot support their original solid weight and deform irreversibly. Typically, they also tend to shrink considerably before they melt, unless they are restrained from shrinking or are treated in advance to be made shrink-resistant. Accordingly, a method of thermal treatment method for making such material shrink-resistant is referred to herein as "annealing". Annealing raises the shrinkable material temperature up to the intended service temperature, and optionally above the service temperature, and then allows the heated material to cool without further stressing. For use in this invention, naturally heat-shrinkable polymeric materials should be heated to at least 450° F., and preferably up to 500° F. followed by cooling to below about 200° F. The duration of high temperature exposure should be long enough to allow the material to shrink. The time at high temperature can be instantaneous and is usually about 30 seconds to about 5 minutes duration. The material should actually equilibrate to the high temperature. Conventional radiation and/or convection heating, for example in ovens, can be utilized to anneal the material. Absorbent pad materials that naturally do not shrink laterally by more than 20% at temperatures of 450° F. and above can be used "as-is" without this annealing process.

Generally in addition to being effectively heat-shrink-resistant, rigid and non-softening at high temperature, the face layer of the absorbent pad of this invention also is microwave-transparent, and liquid porous. The face layer may or may not be fibrous provided that the layer is effectively porous to transfer liquid from the food to the absorbent body layer. Many structures are contemplated such as perforated film or paper, woven, knit or non-woven fabrics, including meshes and nets. Preferably, the face layer, and more preferably, the whole absorbent pad should be free of finishes that might volatilize or decompose on heating and thereby contaminate the food. Spunbonded polyester or polyurethane nonwovens (e.g. Reemay® synthetic fabrics) free of finishes that decompose at about 50° F. are particularly effective. Perforated polyester or polyurethane films or papers or slit film warps that may be woven or bonded without the use of finishes are also preferred.

The face layer may also be formed as a temperature-resistant and/or shrinkage-resistant coating on a suitable substrate. Representative contemplated examples of this are (a) a coating on a foraminous face layer substrate which may in uncoated condition be non- or partially-shrink-resistant, and (b) a foraminous coating directly on the food contact surface of the absorbent body layer. In example (b), the coating itself becomes the face layer. When a coating is used the coating should permit flow of liquid from the food to the absorbent body layer and the face layer should remain microwave-transparent, have resistance to melting at food cooking temperatures and not shrink more than about 20% lateral shrinking during cooking.

In a preferred embodiment the face layer is perforated to enable liquid from the food to easily pass through the face layer to make the food less greasy and to permit the absorbent layer to pick up the free flowing liquid. In another aspect, the face layer can be embossed to provide a surface relief. In a preferred embodiment, the embossing produces concave depressions at the perforations. These depressions promote liquid transfer through the face layer by collecting and funnelling the liquid into the perforations. Surface relief formed by embossing can also enhance stiffness of the face layer.

Texture and smoothness of the face layer surface are not particularly critical to creating low adhesion to the food. Preferably the surface of the face layer should be flat on a macro-scale, i.e., substantially free of survace deviations greater than about 0.5 mm. Surface roughness of a peak-to-valley range in the micro-scale, i.e., less than about 0.5 mm is helpful to reduce adhesion because it provides few points of contact between the face layer and the food.

The body layer of course also should have a melting point above about 450° F. It usually has an open structure consistent with the primary purpose of the body layer to absorb and retain internally the exuded cooking liquids. Typically, the body layer structure comprises fibers, fibrils, pulps or foams. Representative materials include polyester felts, as described in the aforementioned '722 patent. The absorbent body layer can be uniform or layered. If layered, the upper sublayers (i.e., those near the face layer) should have higher melting point and greater resistance to shrinkage. Preferably, the body layer is also free of chemicals and finishes that are incompatible with food packaging. Furthermore additives, chemicals or finishes, other than temperature and shrink resistance agents, that can contaminate the food or otherwise interfere with the operation of the invention by decomposing, melting, evaporating or otherwise penetrating the face layer preferably should be excluded.

Attachment of the face layer to the body layer by coating has been mentioned. Conventional coating methods can be used. It is not critical for purposes of cooking to attach the face layer to the absorbent body layer. In some embodiments, the face layer can be simply deposited on and not affixed to the body layer. Nonetheless mutual attachment of the layers might be desirable for practical product fabrication and handling purposes. Conventional laminating techniques can be used such as adhesive bonding and thermal bonding, provided that the adhesive components can withstand cooking temperatures and do not contaminate the food. The face layer and body layer can also be connected by stitching.

The absorbent pad can be naturally dimensionally stable or, if not, then attached to the pouch or other non-shrinkable cooking container in a manner that the face layer is made dimensionally stable. Optionally the pad can be attached to the container even if it is naturally dimensionally stable.

Various contemplated embodiments of absorbent pad structure according to this invention are illustrated in FIGS.

Figure 2A:
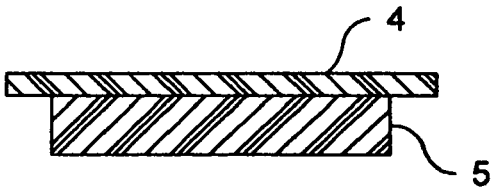
FIG. 2A is a section view of an absorbent pad according to an embodiment of this invention in which the face layer and body layer are each intrinsically resistant to shrinking.

2A–2C. FIG. 2A represents a pad in which the face layer 4, and body layer 5 are each shrink-resistant without treatment, that is, they are naturally shrink-resistant. These are exemplified by some spunbonded polyester nonwoven fabrics that shrink less than 5% before substantially melting when placed on a hot plate that is heated from 450° F. and progressively to 500° F. A convenient test for shrink resistance is to place the composite with the face layer down in contact with a hot plate having a low-friction/easy-release surface (e.g., Teflon® fluoropolymer coated or covered with a sheet of polytetrafluoroethylene "PTFE" or PTFE-coated glass fabric) heated to 500° F. for one minute. The face layer should shrink less than 20%, preferably less than 10%, and more preferably less than 5% and should not soften or partially or fully melt within that time. In situations where a material is high melting, laterally dimensionally stable and able to absorb exuded liquids, a single layer of that material can provide all of the functions of the face layer and the body layer in a single composition, obviating the need for separate layers.

Figure 2C:
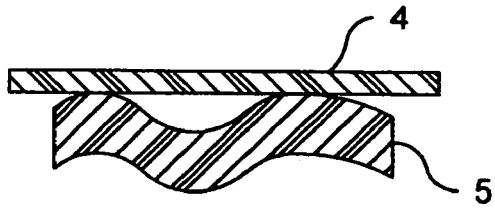
FIG. 2C is a section view of an absorbent pad according to another embodiment of this invention in which the pad has been dimensionally stabilized prior to cooking by pre-shrinking the face layer to a greater extent than the body layer.
Figure 2B:
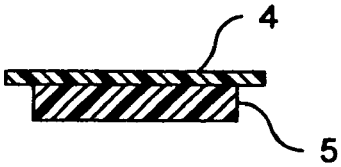
FIG. 2B is a section view of an absorbent pad according to another embodiment of this invention in which a pad of non-intrinsically shrink-resistant material has been dimensionally stabilized prior to cooking by pre-shrinking the face layer and body layer to similar extents.

FIG. 2B illustrates and embodiment in which face and body layer compositions are each initially naturally shrinkable but can be treated to become non-shrinkable. For example, this property can be achieved by heating a thermally shrinkable combined face layer 4 and body layer 5 using radiant, convective or conductive heat so that the face and body layer reach 450° F. Subsequently allowing the composite to cool without stressing at temperatures under 450° F. causes the layers to irreversibly contract to a structure that does not shrink further upon subsequent heating to cooking temperatures.

FIG. 2C shows a pad in which the face layer material shrinks under thermal treatment to a greater extent than the body layer material. With the precursor materials attached, the pad is heated to a temperature in excess of 450° F. and then cooled without stressing. The greater contraction of the face layer causes the body layer to gather. Depending upon the difference in the shrinking characteristics of the two layers, the gathering effect can result in the body layer buckling and separating from the face layer in some locations, however, the two layers will usually remain connected at a plurality of contact points and areas.

Figure 3A:
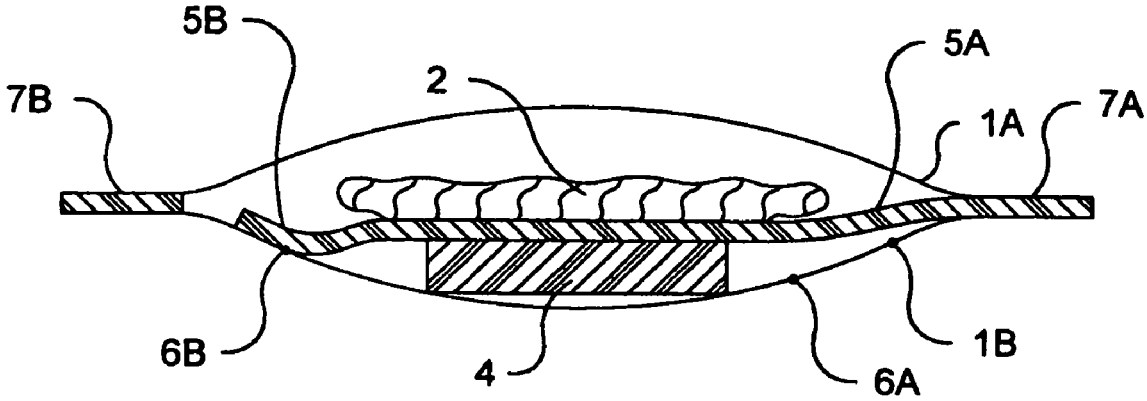
FIG. 3A is a section view of a microwave cooking packaging system showing an absorbent pad according to another embodiment of this invention and illustrating the technique of extending the area of the face layer and anchoring the face layer extensions to the package.
Figure 3B:
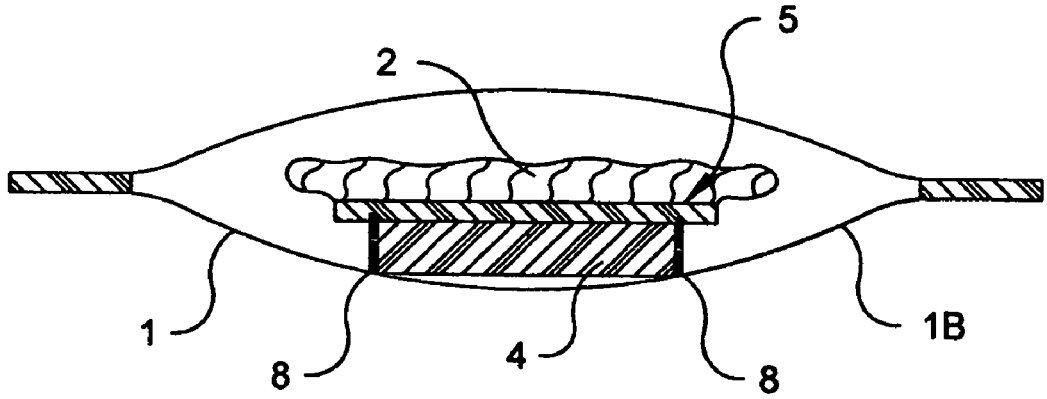
FIG. 3B is a section view of a microwave cooking packaging system showing an absorbent pad according to another embodiment of this invention and illustrating the technique of bonding the pad to the package.

The previously described embodiments are those in which the face layer of the pad either is initially, or can be treated to become, suitably non-shrinkable, for example by subjecting it to a pre-shrinking process before deploying the pad for actual use. It is also contemplated that the beneficial effects of this invention can be obtained by using an absorbent pad of material that if un-fettered might shrink during exposure to cooking temperatures but which is mechanically restrained from shrinking. FIGS. 3A and 3B illustrate selected embodiments of this type of pad.

FIG. 3A shows a microwavable pre-packaged food product in which the face layer 5 extends beyond the body layer across the expanse of the package to edge 7A. Indeed, the end 5A of the face layer is sandwiched and laminated between the upper film 1A and lower film 1B of the pouch at the edge 7A. The other end of the face layer can extend beyond the body layer 4 and be affixed to the pouch film 1B at attaching point 6B. Optionally, the opposite end of the face layer can extend to package edge 7B (not shown). The face layer material can be naturally non-shrinkable or pre-shrunk as explained above. Optionally, the face layer can be heat-shrinkable in this embodiment because the ends of the shrinkable face layer are anchored by the pouch film and thus the layer is restrained by the pouch from contracting. Any combination of attachment configurations, i.e., to the pouch edges, 7A, 7B or pouch film points, 6A,6B, can be used.

In this embodiment, resistance to shrinkage is provided by the pouch. This can be accomplished by forming the pouch of rigid film adapted not to contract. Another technique is to utilize flexible, gas-impervious film. When the food cooks, it typically emits gases and/or the exuded fluids partially vaporize. This causes the pouch to inflate. Inflation makes the pouch become sufficiently rigid to maintain the anchored ends of the face layer apart and thereby overcomes the tendency of face layer material to shrink. FIG. 3B illustrates an embodiment in which an otherwise potentially shrinkable face layer 5 and body layer 4 are bonded at points 8 to the pouch film 1B. The embodiments of FIGS. 3A and 3B should be tested properly by preparing the package and cooking food within the package. Nevertheless the face layers 4 in both cases should also pass the "hot plate" shrinkage test described above.

FIGS. 4A–4D illustrate additional embodiments of the invention in which the absorbent pad is reinforced and/or stiffened to increase the resistance of the face layer to shrink during cooking. One technique utilizes elongated rigid reinforcement elements integrated into the pad in the longitudinal direction, the transverse direction, or both. These elements are continuously or point-bonded to the pad such that the face layer is made dimensionally stable by rigidity of the reinforcement elements. The embodiment shown in FIG. 4A includes microwave-transparent longitudinal reinforcement elements 9 and transverse reinforcement elements 10 in the composite pad. Preferably the reinforcement elements are located near the face layer, and more preferably they are attached directly to the face layer or constitute part of the face layer. Examples of reinforcement elements include polymeric strands or rods, and stiff open mesh. The reinforcement elements should be transparent to, and unaffected by microwave cooking radiation and able to withstand the temperatures of microwave cooking.

Figure 4A:
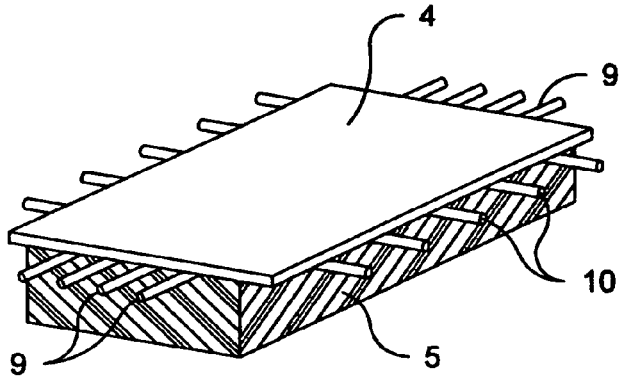
FIG. 4A is a perspective view of another embodiment of this invention in which the pad includes stiffening reinforcement members.
Figure 4B:
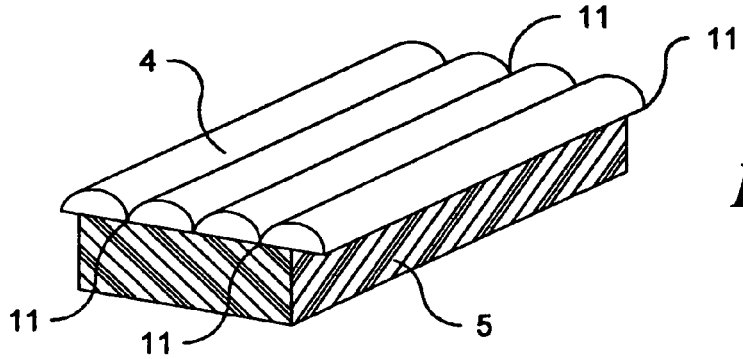
FIG. 4B is a perspective view of another embodiment of this invention in which the face layer includes embossed stiffening ridges aligned in one direction.
Figure 4C:
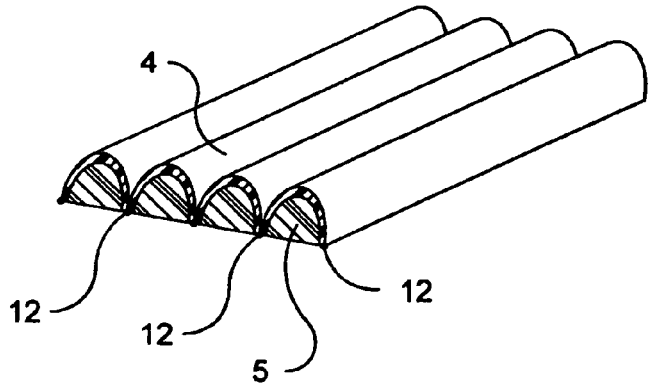
FIG. 4C is a perspective view of another embodiment of this invention in which both the face layer and body layer include embossed stiffening ridges aligned in one direction.
Figure 4D:
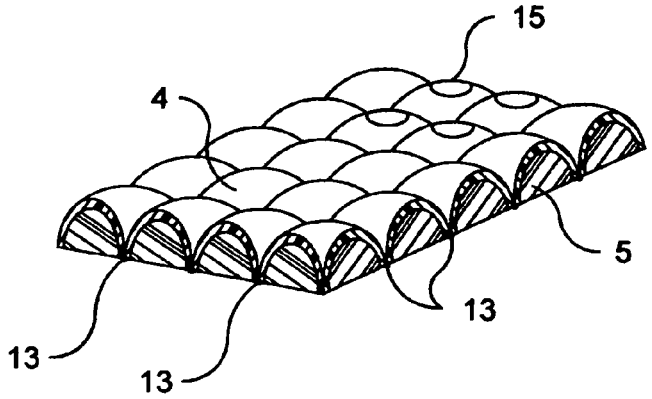
FIG. 4D is a perspective view of another embodiment of this invention in which both the face layer and body layer include embossed stiffening ridges aligned in multiple directions.

FIGS. 4B–4D illustrate embodiments in which resistance to lateral contraction of the face layer during cooking is promoted by pattern embossing the pad. Embossing increases stiffness of the pad and thereby enhances shrink resistance. Also, optional thermal, mechanical or chemical bonding between the face layer and body layer at the embossing contact points serves to anchor the face layer to the body layer. This can further improve resistance to shrinking. FIG. 4B shows linear, parallel channels 11 embossed into the face layer. Pressure embossing densifies the face layer at the embossing lines. The densified lines of face layer material resist contraction in the longitudinal direction. Thermal embossing can transform the face layer material at the embossing lines to stiff, rod-like elements which reinforce the channels and improve resistance to face layer shrinkage.

FIGS. 4C and 4D illustrate embodiments in which pattern embossing extends through the thickness of the whole pad to include the face layer 4 and the body layer 5. In FIG. 4C, pressure and/or thermal embossing produces linear reinforcement elements 12 in the longitudinal direction only and should increase longitudinal shrink resistance of the face layer. In FIG. 4D, embossing lines 13 in the longitudinal and transverse directions create a mounded and dimpled face and body layer absorbent pad. This should improve shrink resistance in both directions. The primary objective of the embossing is to increase resistance of the face layer to shrink during cooking and thereby enhance non-adhesion of the food to the absorbent pad. Thus point embossing patterns and lines other than orthogonally oriented can be useful. In another contemplated embodiment, pattern embossing includes perforating the face layer at a plurality of points 15 on the embossed surface, for example at the peaks and/or valley's of the embossments. This provides passageways for the liquid and can facilitate transferring the exuded liquid from the food to the body layer.

The embodiments of FIGS. 4A, 4B, 4C and 4D can be tested using the hot plate method described above.

EXAMPLES

To illustrate the implementation of this invention, the following representative examples are described.

Example 1

Naturally Shrink-Resistant Absorbent Pad

An absorbent pad consists of a face layer of cellulosic printing paper weighing 3.3 oz./yd.$^2$ on a body layer of a carded and cross-lapped batt of 1.5 denier polyester fibers weighing 4.3 oz./yd.$^2$ needled with 180 penetrations per in.$^2$. The face layer and body layer are glued together at their mutual interface by a light spray application of Super 77 paper adhesive (3M Co., Minneapolis, Minn.). Place the absorbent, dual-layer pad on a polytetrafluoroethylene-coated hot plate at 500° F. with the body layer contacting the plate for one minute. The length and width of the absorbent pad do not change.

Example 2

Annealing a Non-Shrink-Resistant Absorbent Pad

An absorbent pad consists of a face layer of 0.6 oz./yd.$^2$ Reemay® spunbond fabric style 2250 on the body layer of Ex. 1. The face layer and body layer attach together as in Ex. 1. Place the absorbent pad on a polytetrafluoroethylene-coated hot plate at 500° F. with the body layer contacting the plate for one minute. The length and width of the face layer shrink to about 80% of the respective dimensions prior to heating.

Place a new sample 12 inch long×12 inch wide of the absorbent pad in a convection oven and heat at approximately 50° F./min. from room temperature to 480° F. and hold at this temperature for 3 minutes. Shut off power to the oven and allow it to cool to ambient temperature. The cooled absorbent pad is approximately 10 inches long×10 inches wide.

Place the just-annealed absorbent pad on a polytetrafluoroethylene-coated hot plate at 500° F. with the body layer contacting the plate for one minute. The length and width of the absorbent pad each shrink by less than 5% of the respective dimensions prior to heating.

Example 3

Reinforcing a Shrink-Resistant Absorbent Pad with Mesh

Place a sheet of the face layer material of Ex. 2 onto a sheet of 0.25 inch×0.25 inch rectangular opening mesh of 10×10 per inch cotton warp and weft filaments of 280 CN cotton count. Press this assembly between the platens of a hot press at 300° F. and compress the platens to 500 psi pressure for 10 seconds. The mesh bonds to the adjacent surface of the face layer. Place the cotton mesh-reinforced face layer on a body layer of Ex. 1 with the mesh side of the face layer contacting the body layer. Attach the face layer and body layer at their mutual interface as in Ex. 1.

Place the polyester mesh-reinforced absorbent pad on a polytetrafluoroethylene-coated hot plate at 500° F. with the body layer contacting the plate for one minute. The length and width of the absorbent pad each shrink by less than 10% of the respective dimensions prior to heating.

Example 4

Reinforcing a Shrink-Resistant Absorbent Pad by Embossing

Place a 12 inch wide×12 inch long sheet of an untreated sample of the absorbent pad material of Ex. 2 into an embossing press. The embossing press has a ¼ inch thick, soft silicone rubber flat sheet on a back-up plate and an embossing plate having truncated right conical protrusions spaced apart 10 per inch in orthogonal directions (i.e., 100 protrusions per in.$^2$). Each protrusion is 3 mm tall, 2 mm diameter at the base and 1 mm diameter at the tip. Heat the embossing plate to 450° F. and emboss the absorbent pad by compressing the embossing plate against the silicone rubber sheet at 500 psi for 2 seconds. The absorbent pad has 100 deep indentations per square inch with holes of 0.5–1 mm in diameter at the indentations and the face layer and body layer are bonded along the valleys of the embossments.

Place the linear embossed absorbent pad on a polytetrafluoroethylene-coated hot plate at 500° F. with the body layer contacting the plate for one minute. The absorbent pad shrinks by 10% in both orthogonal directions.

Example 5

(Comparative) Cooking Meat with a Shrinkable Absorbent Pad

Shape a 0.25 lb sample of refrigerated lean ground beef into a circular patty approximately 3 inches in diameter. Place the ground beef patty on a six inch by six inch square sample of the shrinkable absorbent pad described in Ex. 2 prior to heat treating. The meat is in contact with the face layer. Place the patty and pad on a ceramic plate with the body layer contacting the plate. Insert the plate into a microwave oven and cook at a setting of 1500 watts for 10 minutes. Remove the plate from the oven and let cool to ambient temperature for 2 minutes. The body layer is wet with absorbed liquid exuded from the meat. Peel the absorbent pad from the cooked patty. The pad moderately adheres to the patty. Isolated patches about 0.5 inch in diameter of meat stick to the pad and pull away from the patty with the absorbent pad. Isolated shreds of absorbent pad stick to the patty while pulling the absorbent pad away.

Example 6

Cooking Meat with a Shrink-Resistant Absorbent Pad

Repeat Ex. 5. using the annealed, pre-shrunk absorbent pad of Ex. 2. The absorbent pad peels away from the cooked patty with no absorbent pad adhering to the patty and only slight tearing of the meat adhering to the absorbent pad.

Example 7

A Microwavable Cooking Package

Place a 4 inch×4 inch square swatch of the absorbent pad of Ex. 1 into a 6 inch×8 inch clear microwave transparent plastic pouch. Place 3 frozen bacon strips 1 inch wide×5 inch long onto the face layer of the absorbent pad. Evacuate the pouch to a vacuum of below 25 mmHg pressure absolute. Heat seal the pouch and place the package in a food freezer at below 10° F. for 2 days.

Place the sealed package into a microwave oven. Heat the package in the oven at 1000 watts for 5 minutes. Allow the package to cool for 1 minute. Slit open the package. Peel the strips away from the absorbent pad. The strips and absorbent peel do not adhere to each other. The body layer is wet with exuded liquid.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. An absorbent pad for microwave cooking comprising a liquid transmissible face layer and a body layer of liquid-retaining, absorbent material in direct contact adjacent to the face layer, the face layer and body layer being microwave transparent, in which the face layer upon exposure to a temperature of at least 450° F. deforms laterally less than 20% of dimensions measured prior to such exposure.

2. The absorbent pad of claim 1 in which the face layer is formed of a shrinkable precursor material thermally treated above 450° F. to become shrink-resistant.

3. The absorbent pad of claim 1 which further comprises a microwave-transparent, rigid reinforcement component attached to the face layer and which renders the face layer more deformation-resistant than would be without the reinforcement component.

4. The absorbent pad of claim 3 in which the reinforcement component comprises polymeric strands or rods.

5. The absorbent pad of claim 3 in which the reinforcement component comprises a stiff open mesh fabric.

6. The absorbent pad of claim 1 in which the face layer comprises pattern embossing effective to render the face layer more deformation-resistant than would be without pattern embossing.

7. The absorbent pad of claim 6 in which the pattern embossed face layer comprises stiff parallel lines of densified face layer material oriented in a single lateral direction.

8. The absorbent pad of claim 6 in which the pattern embossed face layer comprises parallel lines of densified face layer material and body layer material oriented in a single lateral direction.

9. The absorbent pad of claim 6 in which the pattern embossed face layer comprises parallel lines of densified face layer material and body layer material oriented in multiple lateral directions.

10. The absorbent pad of claim 6 in which the pattern embossed face layer defines a plurality of perforations through the face layer operative to transfer liquid from the face layer to the body layer.

* * * * *